US006902302B2

(12) United States Patent
Foster

(10) Patent No.: US 6,902,302 B2
(45) Date of Patent: Jun. 7, 2005

(54) GEL SCROLLER ASSEMBLY FOR A LUMINAIRE

(75) Inventor: Cary L. Foster, Fountain Valley, CA (US)

(73) Assignee: Electronic Theatre Controls, Inc., Middleton, WI (US)

( * ) Notice: Subject to any disclaimer, the term of this patent is extended or adjusted under 35 U.S.C. 154(b) by 29 days.

(21) Appl. No.: 10/459,892

(22) Filed: Jun. 12, 2003

(65) Prior Publication Data

US 2004/0252504 A1 Dec. 16, 2004

(51) Int. Cl.[7] ..... F21V 33/00

(52) U.S. Cl. ..... 362/324; 362/311; 362/321; 362/253

(58) Field of Search ..... 362/311, 321, 362/324, 373, 269, 271, 293, 2, 396, 510, 513, 284, 277, 294, 232, 408, 449, 282, 319, 307, 253

(56) References Cited

U.S. PATENT DOCUMENTS 4,037,097 A * 7/1977 Stillman et al. ..... 362/324
4,602,321 A * 7/1986 Bornhorst ..... 362/268
4,984,143 A * 1/1991 Richardson ..... 362/293
5,515,254 A * 5/1996 Smith et al. ..... 362/293
5,904,417 A * 5/1999 Hewett ..... 362/321
6,113,252 A * 9/2000 Arlitt et al. ..... 362/365
2004/0095761 A1 * 5/2004 Esakoff ..... 362/226

FOREIGN PATENT DOCUMENTS

WO WO 92/22769 * 12/1992

* cited by examiner

*Primary Examiner*—Thomas M. Sember
*Assistant Examiner*—Bao Q. Truong
(74) *Attorney, Agent, or Firm*—Greer, Burns & Crain, Ltd.; Philip M. Kolehmainen

(57) ABSTRACT

A cassette containing a gel scroll is releasably attached to the forward portion of a housing of a luminaire. A light path through the cassette is aligned with a light exit opening of the luminaire. A gel scroll is wound upon a pair of drums in the cassette and intersects the light path. The drive motor for the cassette is contained in the housing of the luminaire. A drive system for the drums includes a driven member in the cassette that engages a drive member of the luminaire driven by the motor when the cassette is mounted on the luminaire. A fan in the luminaire moves cooling air through the cassette when the cassette is mounted on the luminaire.

15 Claims, 5 Drawing Sheets

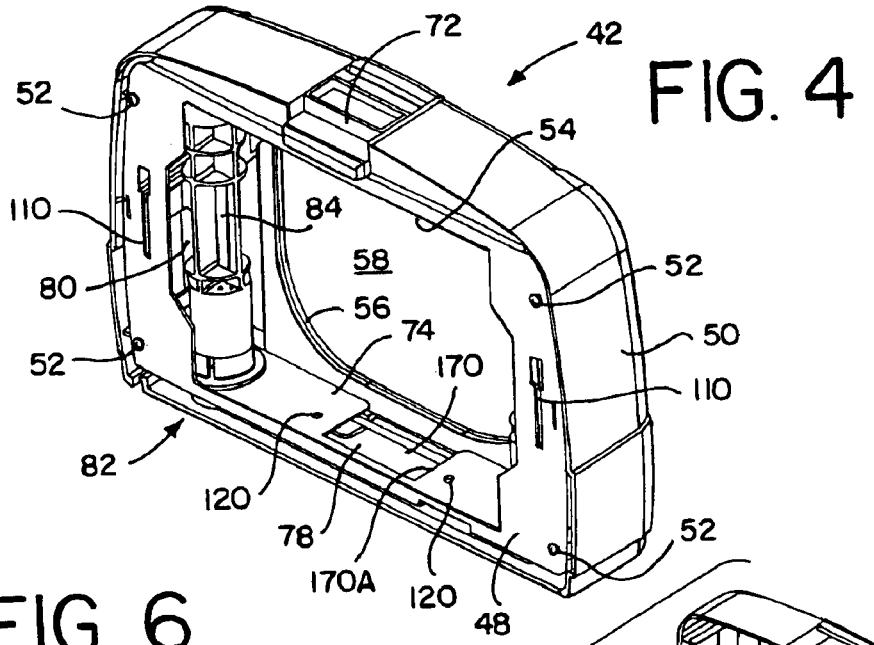
FIG. 4
FIG. 6
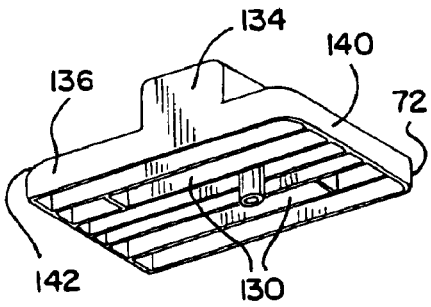
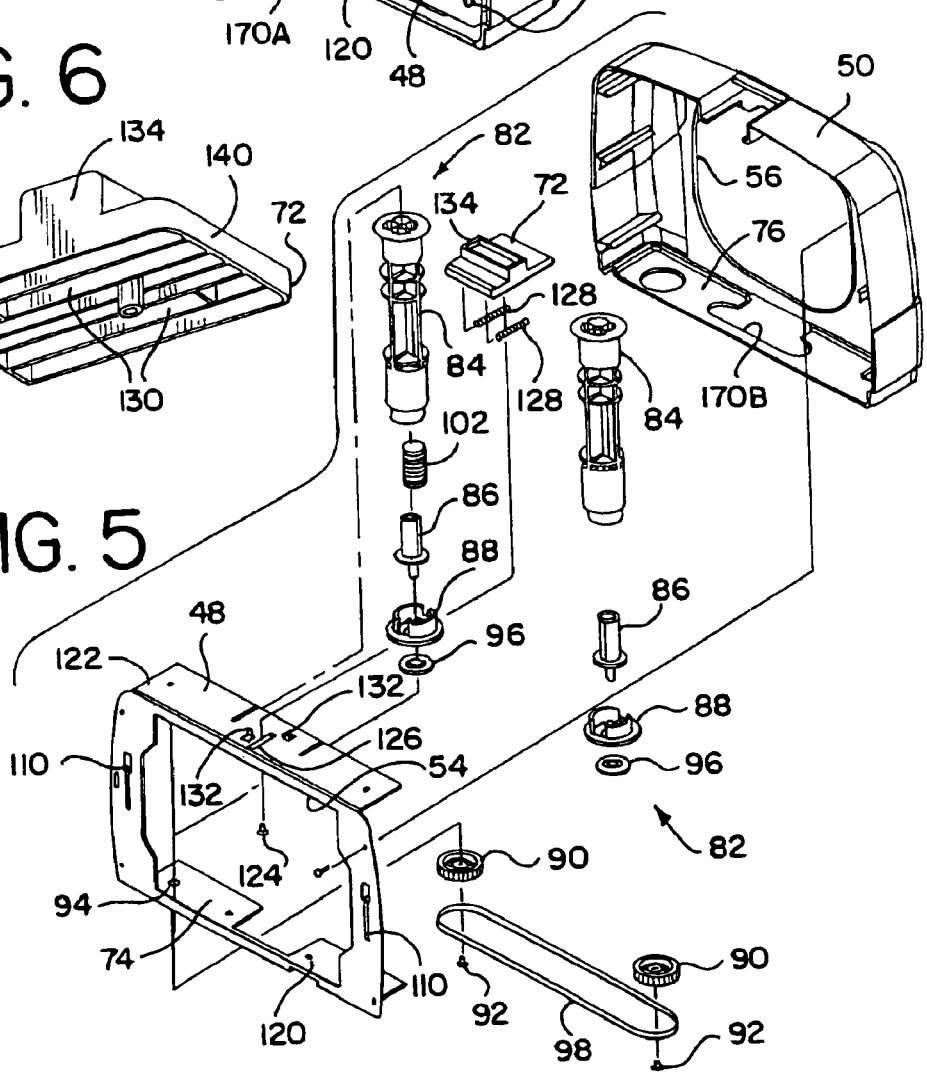
FIG. 5

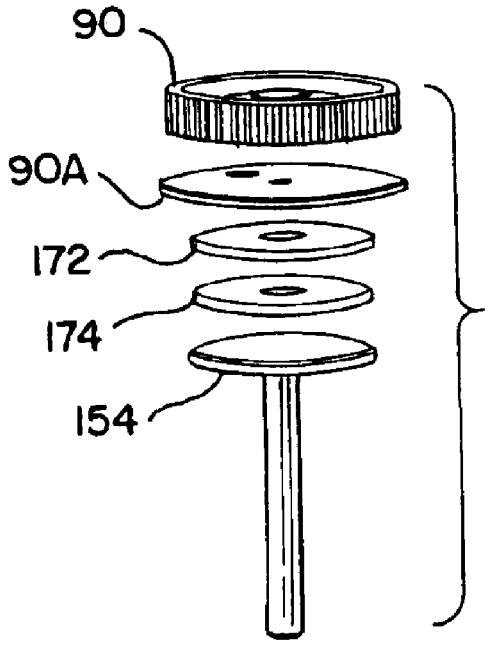
FIG. 10
FIG. 11
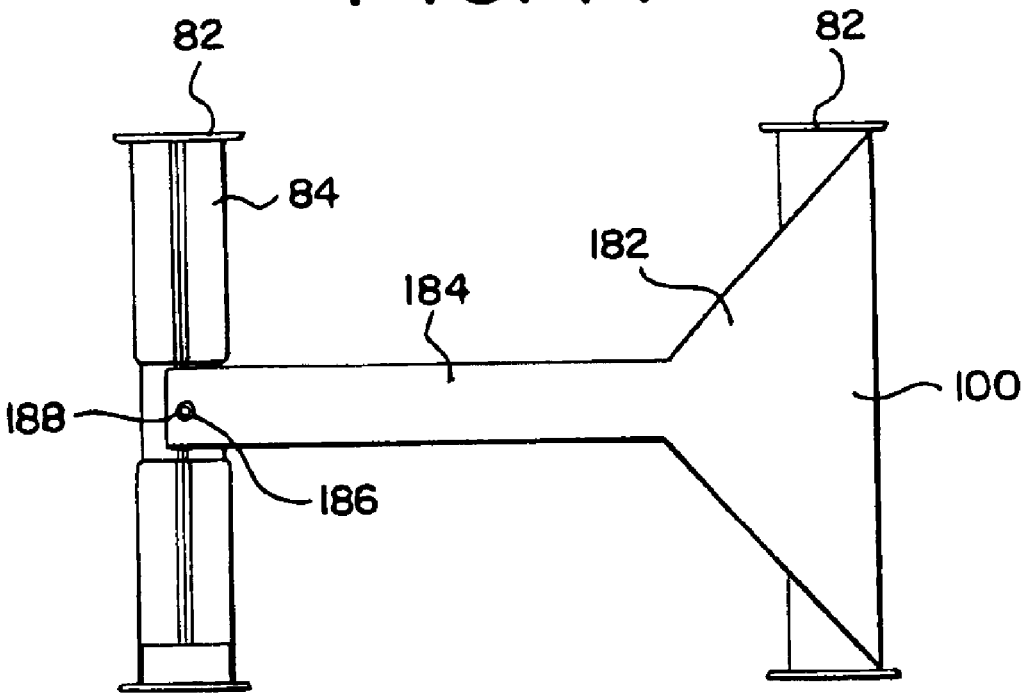

GEL SCROLLER ASSEMBLY FOR A LUMINAIRE

FIELD OF THE INVENTION

The present invention relates to an improved gel scroller assembly for a luminaire.

DESCRIPTION OF THE PRIOR ART

Luminaires, or lighting fixtures, including a housing containing a light source and an optical system are used for creating lighting effects for entertainment and architectural applications such as stages, studios, buildings, themed parks, churches, museums, restaurants and the like. A colored beam or wash of light is one frequently desired lighting effect. One widely used way to provide colored light is to use a gel, i.e., a translucent colored film, in the light path of a luminaire to add color to the emitted light.

In some luminaire systems, a single gel is simply mounted in the light path to provide a single color. For example, the gel can be supported in a frame that is mounted in a holder provided at the light exit opening located at the front of the luminaire. Although this is a simple and inexpensive way to achieve color, it is time consuming and inconvenient to change colors because the gel has to be removed and replaced with a new gel of a different color.

In order to automate the color changing process, motor driven gel changers have been provided. In one such approach, a gel scroller assembly is mounted to the front of the luminaire. The assembly includes a movable gel medium in the form of a gel scroll having a sequence of different colors wound around spaced drums or reels. The assembly is self contained, and includes a drive system with a motor for moving the gel medium to a selected position to achieve a desired color.

Self contained gel changers provide the capability of automated color changing, but are subject to disadvantages. Because the assembly includes the gel drive system with a motor and drive components, and perhaps also a cooling fan, it is expensive and cumbersome. Because of the cost of a self contained motor driven gel changer, the normal way to change gel media is to remove the original medium and install a new medium into the gel changer. In addition, power and control cabling must be provided for the gel changer. Known gel changers are attached to the luminaire with fasteners requiring tools and the use of both hands to attach or replace the gel changer.

SUMMARY OF THE INVENTION

A primary object of the present invention is to provide an improved gel scroller assembly for a luminaire. Other objects are to provide a gel scroller assembly including a scroller cassette that is inexpensive and light in weight; to provide a gel scroller assembly including a scroller cassette that can easily be mounted onto or detached from a luminaire with one hand and without tools; to provide a gel scroller cassette of low cost that permits the user to exchange the entire gel scroller cassette in order to change color arrays rather than to change the gel scroll in a single cassette; to provide a changer assembly for a light modifying medium that does not require the weight, expense or cabling requirements of a self contained changer unit; and to provide a gel scroller assembly overcoming disadvantages of gel scrollers used in the past.

In brief, in accordance with the invention there is provided a gel scroller assembly for a luminaire having a housing with a light beam exit opening. The scroller assembly includes a motor drive assembly mounted in the housing of the luminaire. The motor drive assembly includes a motor and a driver element driven by the motor and positioned adjacent to the exit opening. A scroller cassette includes a light passage. A latching system releasably attaches the scroller cassette in an operating position on the luminaire housing with the light passage aligned with the exit opening. The scroller cassette includes a gel scroll drive system for moving a gel scroll across the light passage. The drive system includes a driven member engaged by the driver element in the operating position of the scroller cassette.

BRIEF DESCRIPTION OF THE DRAWING

The present invention together with the above and other objects and advantages may best be understood from the following detailed description of the preferred embodiment of the invention illustrated in the drawings, wherein:

FIG. 4 is an enlarged top, side and rear isometric view of the scroller cassette;

FIG. 5 is a top, side and rear exploded isometric view of components of the scroller cassette;

FIG. 6 is a greatly enlarged isometric bottom view of the scroller cassette latch member;

FIG. 10 is an enlarged exploded isometric view of components of the gel drive system; and FIG. 11 is an elevational view of the gel drums and gel scroll of the scroller cassette.

DESCRIPTION OF THE PREFERRED EMBODIMENT

Figure 1:
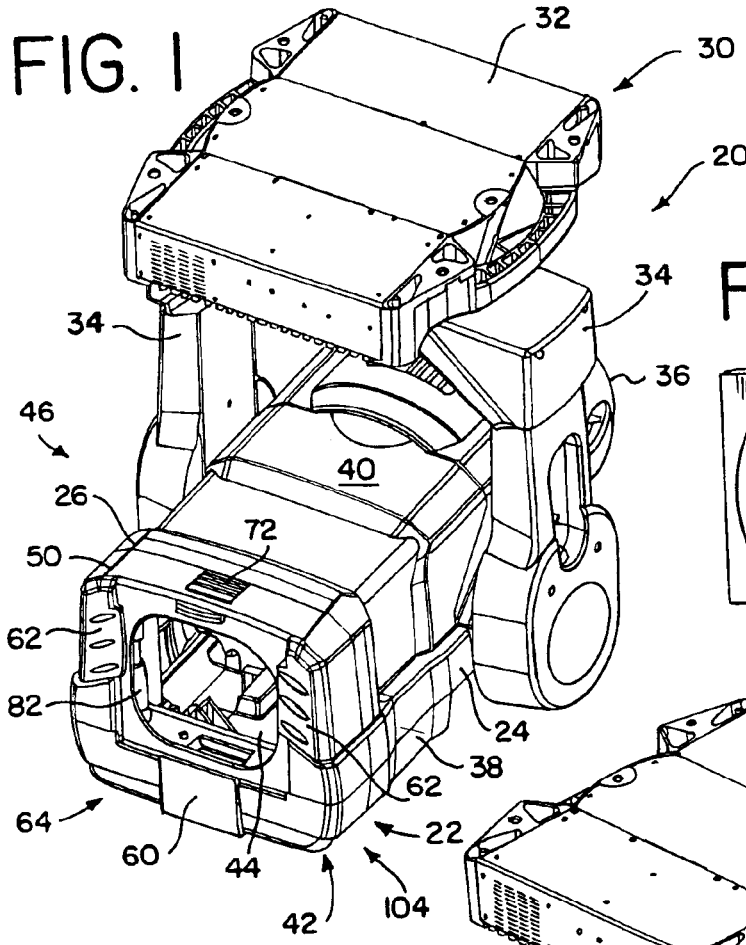
FIG. 1 is a front, side and top isometric view of a theatrical luminaire having a gel scroller assembly constructed in accordance with the present invention.
Figure 2:
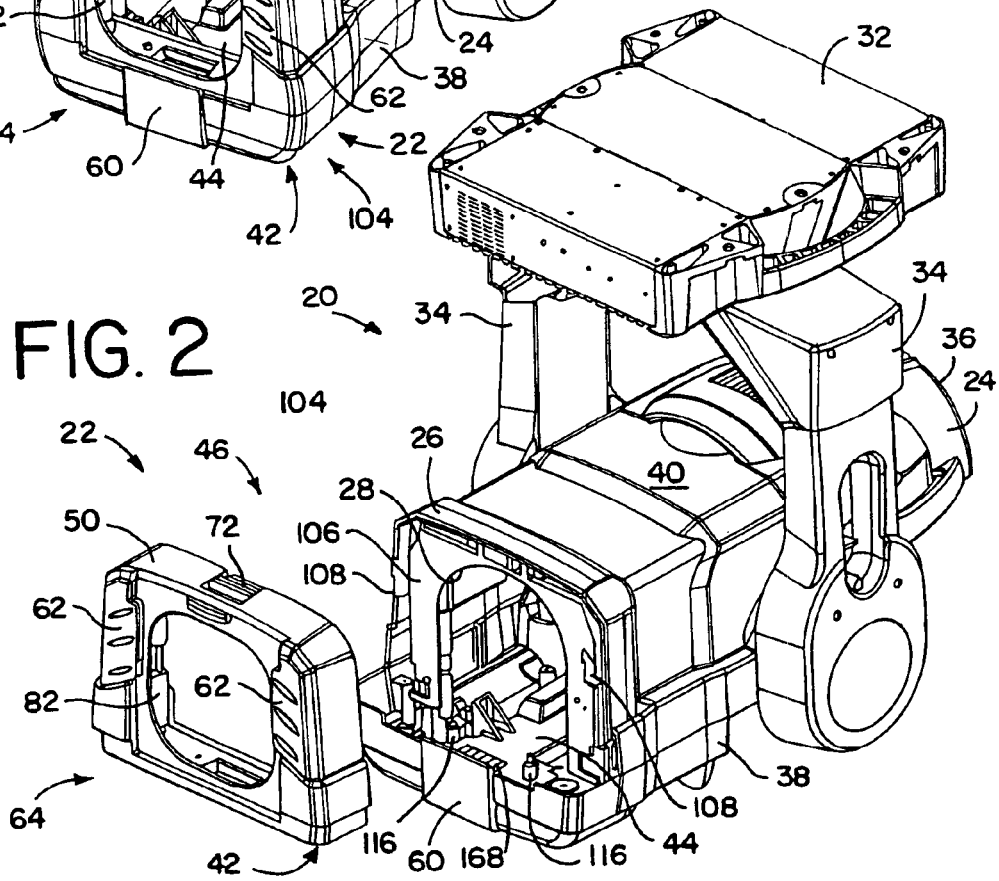
FIG. 2 is a side, front and top isometric view of the theatrical luminaire with the gel scroller cassette removed from the housing of the luminaire.

Having reference now to the drawing, and initially to FIGS. 1 and 2, there is illustrated a luminaire generally designated as 20 provided with a gel scroller assembly generally designated as 22 constructed in accordance with the principles of the present invention. Although the illustrated preferred embodiment of the invention incorporates the gel scroller assembly 22, media other than gel may be used to modify light from the luminaire 20, for example an array of gobos, translucent light diffusing material or a dichroic medium. At least some of the aspects of the invention are applicable to assemblies including light modifying media other than gel. In addition, at least some aspects of the invention may be applicable to gel changer assemblies other than gel scrollers.

The luminaire 20 is a theatrical luminaire, capable of creating theatrical or theatre-like lighting effects for a variety of entertainment and architectural applications. However, features of the invention are useful with other luminaires. The luminaire 20 has a housing 24 with a front portion 26 having a light exit opening 28. The housing 24 is supported for pan and tilt movement by a yoke assembly 30 including a base 32 and support arms 34. A light source such as a lamp is contained in a rear portion 36 of the housing 24, and an optical system between the light source and the exit opening 28 provides an optically formed light beam. The housing 24 is moved to aim a beam of light emitted through the opening 28 at a target or an area, such as a part of a building or stage or the like.

The housing 24 includes a base member 38 that serves as an optical rail for supporting and positioning components of the luminaire 20 such as the light source and elements of the optical system. A cover 40 is attached to the base 36 and cooperates with the base 36 to form an enclosure for the internal components of the luminaire 20.

In accordance with the present invention, the gel scroller assembly 22 includes a gel scroller cassette 42 that is releasably attached to the housing 24. The gel scroller assembly 22 also includes a drive, fan and control board unit 44 that is mounted within the housing 24 near the light exit opening 28. The drive, fan and control board unit 44 remains in place within the housing 24 when the gel scroller cassette 42 is removed from the housing 24 as shown in FIG. 2. An interface coupling assembly 46 connects the drive, fan and control board unit 44 to the gel scroller cassette 42 when the cassette 42 is mounted upon the housing 24 as seen in FIG. 1 in order to provide mechanical power and cooling air flow to the cassette 42.

The scroller cassette 42, best seen in FIGS. 4 and 5, includes a frame 48, preferably a stamped and formed sheet metal part, and a cover 50, preferable a molded plastic part. The frame 48 and cover 50 are held together by fasteners 52 (FIG. 4). Aligned openings 54 and 56 in the frame 48 and cover 50 respectively define a light passage 58 that is aligned with the light exit opening 28 of the housing 24 when the cassette 42 is in place on the housing 24. A beam of light emitted from the housing 24 passes through the light passage 58.

Figure 3:
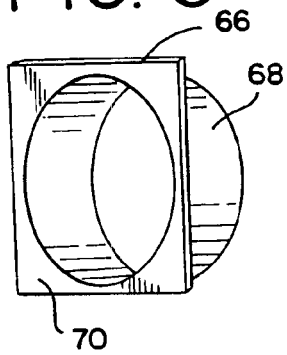
FIG. 3 is an isometric view of a top hat accessory that can be mounted in the accessory holder at the front of the scroller cassette.

When the scroller cassette 42 is installed on the luminaire housing 24, a tab 60 of housing 24 is located slightly in front of the cover 50 of the cassette 42 (FIG. 1). An opposed pair of flanges 62 at the upper front corners of the cover 50 are generally coplanar with the tab 60, and cooperate with the tab 60 to define an accessory mounting nest 64. An accessory, such as the top hat light shield 66 seen in FIG. 3, can be mounted in the nest 64. Shield 66 includes a circular cylindrical light guide 68 and a flat planar base 70. The base 70 can be inserted down between the flanges 62 and behind the tab 60 where it is retained by a latch member 72 described below. Other accessories such as louvers or other types of light guides can be placed in the accessory mounting nest 64. If the cassette 42 does not contain a gel, or if it is desired to add an additional gel, a individual gel frame can be placed in the nest 64.

A base wall 74 of the cassette frame 48 is spaced above a bottom wall 76 of the cassette cover 50 to define a lower chamber 78. A pair of side chambers 80 are formed between the frame 48 and the cover 50 at opposite sides of the light passage 58. A drum assembly 82 is mounted in each side chamber 80. Each drum assembly 82 includes a rotatably mounted drum 84, an axle 86 and a lower end cap 88 above the base wall 74. A drum drive pulley 90 is located below the wall 74 within the lower chamber 78 and is attached to the corresponding lower end cap 88 by a fastener 92 (FIG. 5) extending through an opening 94 in the wall 74. A bearing 96 reduces friction between the wall 74 and the end cap 88.

A drive belt 98 located within the lower chamber 78 engages both drive pulleys 90 for simultaneous rotation of the spaced drum assemblies 82. A scroll 100 or elongated web of gel material (shown only in FIG. 11) is wound onto the drums 84 of the assemblies 82 and is wound back and forth between the drums as the drums are rotated. The scroll 100 typically includes an array of segments of different colors and a selected color can be placed across the light passage 58 by controlled rotation of the drum assemblies 82. A gel tension torsion spring 102 mounted within one of the drum assemblies 82 (FIG. 5) accommodates the variations in the effective diameters of the drums resulting from winding the scroll 100 on the drums 84.

A latching system generally designated as 104 releasably attaches the gel scroller cassette 42 to the front portion 26 of the luminaire housing 24 over the light exit opening 28. The light exit opening 28 is defined in a front plate 106, and the latching system 104 includes a pair of catches 108 at the outer edges of the plate 106 at opposite sides of the opening 28 (FIG. 2). Frame 48 of the cassette 42 includes a pair of slots 110 that mate with the catches 108 (FIGS. 4 and 5).

The drive, fan and control board unit 44 includes a housing 112 and a base 113 attached by fasteners 114 (FIG. 8) to the luminaire housing base member 38 at the front portion 26 of the housing 24. A pair of positioning pedestals 116 are carried by the frame 112. When the catches 108 are received into the slots 110 and the cassette 42 is lowered in place, pins 118 on the pedestals 116 are received into holes 120 in the base wall 74 of the frame 48. The cassette 42 is accurately positioned in the side-to-side (X) and the forward-and-back (Y) planes by engagement of the catches 108 in the slots 110 and by engagement of the pins 118 in the holes 120. The base wall 74 rests on the upper surfaces of the pedestals 116 to accurately position the cassette 74 in the up-and-down (Z) plane.

The latch 72 releasably retains the scroller cassette 42 in the installed position of FIG. 1. The latch 72 is slideably retained on a top wall 122 of the cassette frame 48 by a fastener 124 extending through a slot 126 in wall 122. The latch 72 is normally held in a centered position by a pair of springs 128 seated in spring cavities 130 in the underside of the latch 72 (FIG. 6). The springs 128 bear against tabs 132 (FIG. 5) extending up from the wall 122. A button 134 on the top of the latch 72 is used to slide the latch forward or rearward against a return force provided by one of the springs 128. A rear latch nose 136 normally engages a mating latch opening 138 in the front plate 106 to retain the scroller cassette 42 in the installed position. The latch 72 also includes a forward latch nose 140 that normally extends forward to retain an accessory in the accessory mounting nest 64.

Loading or removing the scroller cassette 42 is a quick and easy one-hand operation. The user holds the cassette in the hand and places it at the front portion 28 of the luminaire housing 24 so that the catches 108 enter the slots 110. The cassette is moved down so that the pins 118 are received into the holes 120. A chamfer 142 on the rear latch nose 136 causes the latch 72 to slide forward from its normal centered position as the nose 136 engages the front plate 106 or the housing cover 40. As the cassette 42 reaches its installed position. the rear latch nose 136 is aligned with the latch opening 138 and the latch is returned forward by one of the springs 128. The nose 136 enters the opening 130 the retain the cassette in place.

To remove the cassette, the user moves the button 134 forward to withdraw the rear latch nose 136 from the latch opening 138. Then the cassette 42 is simply lifted from the luminaire housing 24 and moved forward, as pins 118 withdraw from holes 120 and slots 110 move free of catches 108. To install or remove an accessory such as the light shield 66 from the accessory nest 64, the user slides the button 134 rearward so that the forward latch nose 140 moves clear of the region between the flanges 62. An accessory can then be moved vertically into or out of the nest 64.

Figure 8:
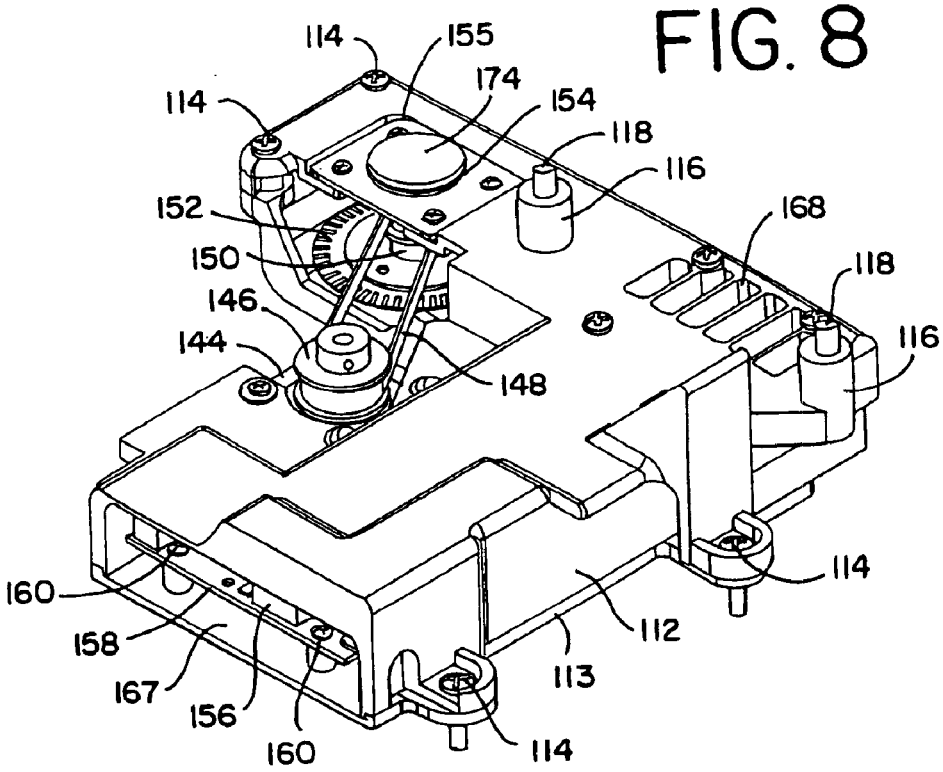
FIG. 8 is an enlarged rear, top and side isometric view of the gel drive, fan and control board unit of the gel scroller assembly.
Figure 9:
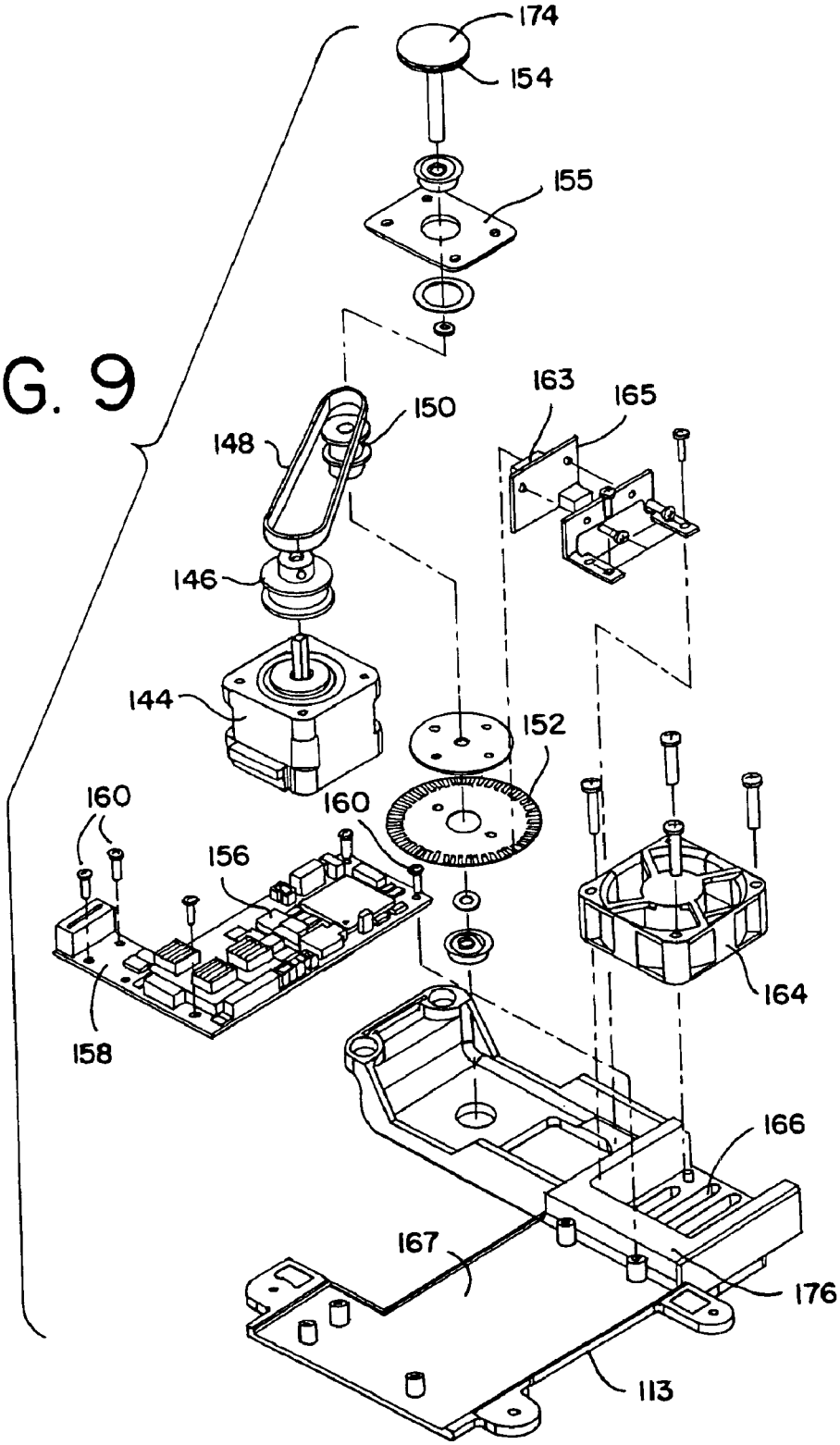
FIG. 9 is an exploded isometric view of the gel drive, fan and control board unit.

When the cassette 42 is installed on the luminaire housing 24, the drive, fan and control board unit 44 is interconnected with the scroller cassette 42 by the interface coupling assembly 46. The drive, fan and control board unit 44 includes a drive motor 144 that rotates a drive gear 146 (FIGS. 8 and 9). A drive belt 148 engages the drive gear 146 and a driven hub gear 150. A toothed position wheel 152 and a cassette drive hub 154 at opposite sides of a support plate 155 are connected for simultaneous rotation with the driven hub gear 150.

Figure 7:
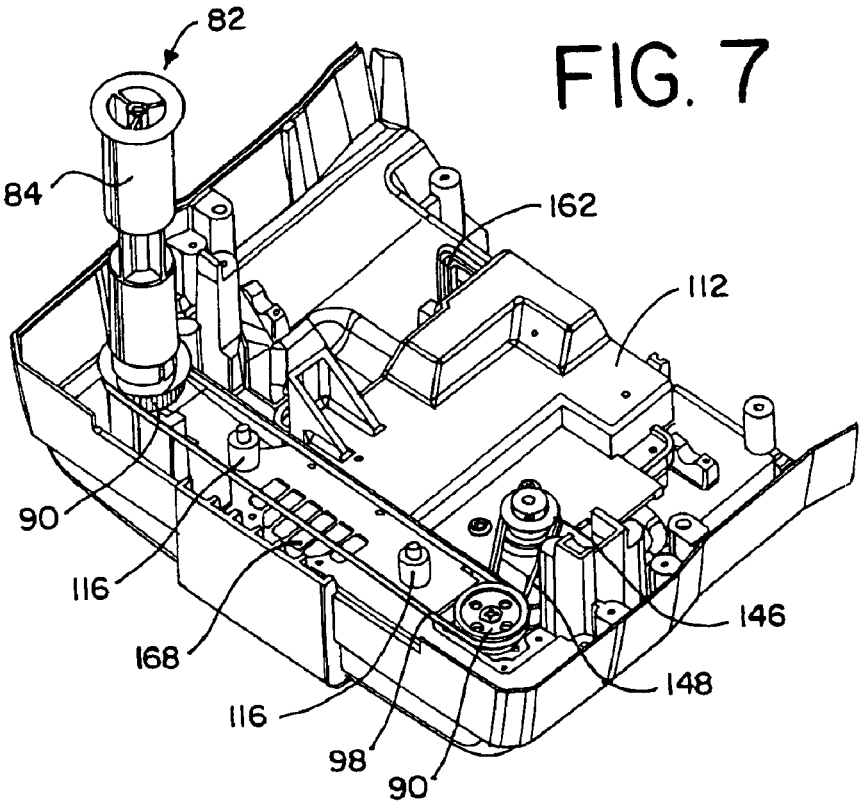
FIG. 7 is a fragmentary, top, side and front isometric view of components of the gel scroller assembly in the luminaire housing, with the top cover of the housing and the scroller cassette, except for one drum assembly and one drive pulley, removed.

A control circuit 156 for components including at least the drive motor 144 is mounted at least in part on a control circuit board 158 attached by fasteners 160 to the base 113 (FIG. 7). A cable harness 162 (FIG. 7) is connected to the control circuit board 158 of the drive, fan and control board unit 44 Position feedback information is provided by a position sensor 163 that senses the position wheel 152 and is mounted on a gel position circuit board 165. As seen in FIG. 8, the control circuit board 158 is mounted in a cooing air flow channel 167 defined between the housing 112 and the base 113.

A cooling fan 164 is mounted to the base 113. The fan 164 includes a flow port array 166, preferably an outlet flow port, directed down into the luminaire housing 24. A second port array, preferably an inlet flow port, is defined in a louvered flow grate 168 opening at the upper surface of the housing 112.

The flow port 168, the cassette drive hub 154 and one of the drum drive pulleys 90, together with a cooling air flow opening 170 in the cassette base wall 74 are components of the interface coupling assembly 46. The opening 170 includes an opening 170A in the base wall of the cassette frame 48 and an opening 170B in the in the 4 bottom wall of the cassette cover 50 (FIG. 5).

The flow port 168 and the cassette drive hub 154 are located upon the housing 112 in positions to register with the gel scroller cassette 42 when the cassette is installed. In the installed position, the cassette drive hub 154 is coupled in a drive relationship to one of the drum drive pulleys 90. In the preferred embodiment, a pair of hook and loop fastener pads 172 and 174 provide a releasable drive connection between the cassette drive hub 154 and the drum drive pulley 90.

As can be seen in FIG. 10, a pulley shoulder plate 90A defines a flat bottom pulley surface at the underside of the pulley 90. An annular hook fastener pad 172 is adhered to the plate 90A. A mating annular loop fastener pad 174 is adhered to the top surface of the cassette drive hub 154. For example, the mating pads 173 and 176 may be self adhesive pads of VELCO (registered trademark of Velcro Industries) brand hook and loop material. When the cassette 42 is installed, the pad 172 engages the pad 174, establishing a mechanical drive connection between the drive, fan and control board unit 44 and the gel scroller cassette 42 to rotate the gel drum assemblies 82 in response to rotation of the gel; drive motor 144. The hook and loop fastener pads 172 and 176 provide a reliable, releasable connection with a long service life. There is no need to locate the pulley 90 and the drive hub 154 in any particular angular relationship in order to make the connection. There is no free play in the connection and it operates quietly.

A cooling air path is provided by the interface coupling assembly 46 between the interior of the gel scroller cassette and the interior of the luminaire housing 24. In the installed position of the scroller cassette 42, the cooling air flow opening 170 of the cassette 42 is aligned with the flow port 168 of the drive, fan and control board unit 44. Part of the cooling air flowing through the fan 164 travels downward through the outlet flow port 166 and directly into the luminaire housing 24. Another portion of the cooling air flow travels radially outwardly over a wall 176 (FIG. 9) an through the cooling air flow channel 167 to cool components of the control circuit 156 mounted on the circuit board 158.

The gel scroll 100 is a continuous elongated web of gel material having one or more varying characteristics, such as color or translucency, along its length. To change the effect of the scroll upon a light beam in the light passage 58 of the cassette 42, the drums 84 are rotated to transfer the scroll 100 in selected alternate directions from drum to drum. As seen in FIG. 11, the cassette 42 includes a simple and self aligning scroll mounting system generally designated as 178. Each of the two ends 180 of the scroll 100 has a tapered section 182 terminating in an elongated narrow end segment 184 having a securing hole 186 at its end. The hole 186 engages a recessed attachment post 188 of the corresponding drum 84. This provides a mechanical connection permitting the scroll 100 to be wound upon the drum 84. The scroll end can pivot about the post 188 and moves into the properly aligned position as the scroll is wound upon the drum. There is no need for adhesive tape or other separate fastening devices. the narrow portion 184 can be positioned in the light path to minimize the presence of the gel in the light beam.

When the gel scroller cassette is installed as seen in FIG. 1, as a result of the interface coupling assembly 46, the drive motor 144 can be operated by the control circuit 156 to move the gel scroll 100 between the drums 84. Rotation of the drive motor 144 rotates the drive gear 146 so that the drive belt 148 rotates the driven hub gear 150 and the cassette drive hub 154 together with the position wheel 152. The cassette drive hub 154 is mechanically engaged with the corresponding drum drive pulley 90, and the drive belt 98 engaging both pulleys 90 causes both drums 84 to rotate in a selected direction in order to position a desired segment of the gel scroll 100 in the light passage 58.

A cooling air flow path is also established by the interface coupling assembly 46 when the cassette 42 is installed. The cooling air flow opening 170 of the cassette 42 registers with the flow port 168. When the cooling fan 164 operates, air flows along a path including the interior of the cassette 42 behind the plane of the gel scroll 100, through the opening 170 and into the flow port 168 of the fan 164. The service life of the gel scroll is extended by the reduced heat resulting from the cooling air flow. In the preferred arrangement, cooling air is drawn into the cassette 42 from the exterior of the luminaire housing 24 and flows through the interior of the cassette, cooling the gel scroll 100, and into the interior of the housing 24 where it provides cooling of other components including the control circuit 156 located in the channel 167.

Because the drive, fan and control board unit 44 including the drive motor 144, circuit board 158 and cooling fan 164 are mounted in the luminaire housing 24 and not within the gel scroller cassette 42, the cassette 42 is relative light in weight and low in cost. An advantage of this arrangement is that the cassette can be installed and removed easily and quickly. Due to its low cost, it is practical to have a number of scroller cassettes 42 at hand for a luminaire 20 and, for example, to change color scrolls by replacing one cassette 42 with another rather than by changing the scroll in a single cassette 42. Because neither the drive motor 144 nor the fan 164 is in the scroller cassette 42, they can receive power and control signals provided within the luminaire 20 and it is not necessary to extend electrical connections or to connect electrical cables or conductors to the cassette 42.

While the present invention has been described with reference to the details of the embodiments of the invention shown in the drawing, these details are not intended to limit the scope of the invention as claimed in the appended claims.

What is claimed is:

1. A gel scroller assembly for a luminaire having a housing with a light beam exit opening, said scroller assembly comprising:

a motor drive assembly mounted in the housing;

said motor drive assembly including a motor and a driver element driven by said motor and positioned adjacent to the exit opening;

a scroller cassette including a light passage;

a latching system releasably attaching said scroller cassette in an operating position on said housing with said light passage aligned with the exit opening;

said scroller cassette including a gel scroll drive system for moving a gel scroll across said light passage; and said drive system including a driven member engaged by said driver element in said operating position of said scroller cassette.

2. The gel scroller assembly of claim 1 further comprising a fan mounted in said housing, a fan air opening in said housing communicating with said fan, and said scroller cassette including a port aligned with said air opening in said operating position of said scroller cassette for the movement of air through said air opening and said port.

3. The gel scroller assembly of claim 1, said latching system including a manually moveable latch member.

4. The gel scroller assembly of claim 1, said drive system including a pair of drums and a drive component coupled to said driven member for rotating said drums simultaneously, said driver element comprising a rotatable driver element, and said driven member including a rotatable member coupled to said rotatable driver element.

5. The gel scroller assembly of claim 4 further comprising a fan mounted in said housing, a fan air opening in said housing communicating with said fan, and said scroller cassette including a port aligned with said air opening in said operating position of said scroller cassette for the movement of air through said air opening and said port.

6. The gel scroller assembly of claim 5, said cassette being removable from the luminaire housing upon release of said latching system, said driver element separating from said driven member and said fan air opening separating from said port upon removal of said cassette from the luminaire housing.

7. The gel scroller assembly of claim 4, at least one of said drums having a recessed post, and a gel scroll having an end segment with an aperture receiving said recessed post.

8. The gel scroller assembly of claim 4, further comprising a pair of releasable hook and loop fastener elements connected between said driver element and said driven member.

9. A mechanically driven gel scroller cassette comprising:

a cassette housing defining a light beam path through said cassette housing;

a pair of gel scroll drums at opposite sides of said light beam path;

a gel scroll wound upon said drums and intersecting said light beam path;

a drive mechanism in said cassette housing spaced from said gel scroll interconnecting said drums for simultaneous rotation; and a mechanically driven element in said cassette housing coupled to said drive mechanism, said driven element having only a single drive connection accessible from the exterior of said cassette housing.

10. The gel scroller cassette of claim 9, at least one of said drums having a recessed post, and said gel scroll having an end segment with an aperture receiving said recessed post.

11. A mechanically driven gel scroller cassette comprising:

a cassette housing defining a light beam path through said cassette housing;

a pair of gel scroll drums at opposite sides of said light beam path;

a gel scroll wound upon said drums and intersecting said light beam path;

a drive mechanism interconnecting said drums for simultaneous rotation; and a mechanically driven element coupled to said drive mechanism, said driven element having a drive connection accessible from the exterior of the cassette housing;

said drive connection comprising part of a hook and loop fastener pair.

12. A light modifying medium changer assembly for a luminaire having a housing including a light beam exit opening, said changer assembly comprising:

a motor drive assembly mounted in the housing;

said motor drive assembly including a motor and a driver element driven by said motor and positioned adjacent to the exit opening;

a cassette having a light passage;

a latching system releasably attaching said cassette in an operating position on said housing with said light passage aligned with the exit opening;

said cassette including a light modifying medium and a drive system for moving said light modifying medium relative to said light passage; and said drive system including a driven member engaged by said driver element in said operating position of said cassette.

13. A medium changer assembly as claimed in claim 12, said medium comprising a scroll, and said drive system including a pair of drums.

14. A medium changer assembly as claimed in claim 13, said scroll comprising a gel scroll.

15. A medium changer assembly as claimed in claim 12, further comprising a fan mounted in said housing, a fan air opening in said housing communicating with said fan, and said cassette including a port aligned with said air opening in said operating position of said cassette for the movement of air through said air opening and said port.

* * * * *